United States Patent [19]

Beyl

[11] Patent Number: 4,762,328

[45] Date of Patent: Aug. 9, 1988

[54] ARROWHEAD WITH REFILLABLE CARTRIDGES FOR HIGH IMPACT ARROWS

[76] Inventor: James A. Beyl, 633 E. Lamme, Bozeman, Mont. 59715

[21] Appl. No.: 836,546

[22] Filed: Mar. 5, 1986

[51] Int. Cl.[4] ..... F41B 5/02

[52] U.S. Cl. ..... 273/420; 102/507

[58] Field of Search ..... 273/416, 419, 420, 421, 273/422; 102/507-510

[56] References Cited

U.S. PATENT DOCUMENTS 3,427,976 2/1969 Locy ..... 102/507

3,941,059 3/1976 Cobb ..... 102/510

4,396,196 8/1983 Drennan ..... 273/420

FOREIGN PATENT DOCUMENTS 60850 2/1892 Fed. Rep. of Germany ..... 102/507

*Primary Examiner*—Paul E. Shapiro

[57] ABSTRACT

An arrowhead that incorporates refillable cartridges for high velocity arrows used in hunting big and small game. The unique feature of the design of this arrowhead is that the refillable cartridge spreads three splines in a flare-out type action, producing high energy impact.

1 Claim, 6 Drawing Sheets

FIG. 13
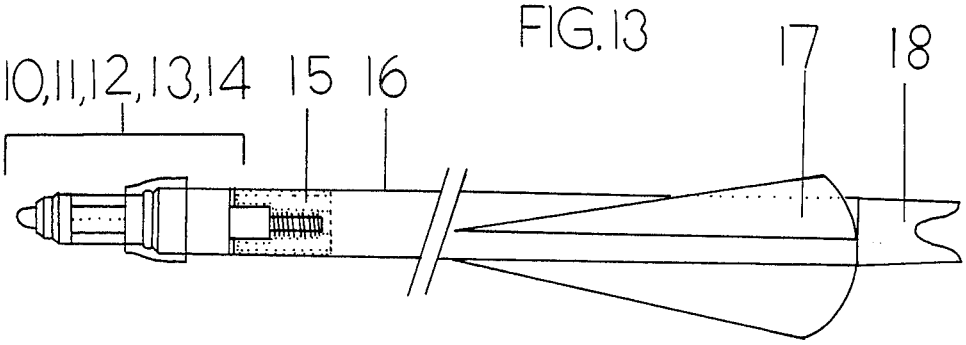
FIG. 14
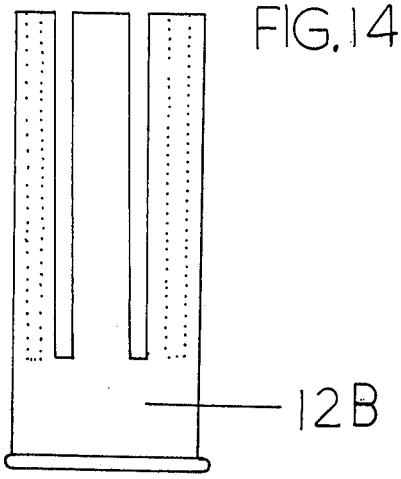
FIG. 15
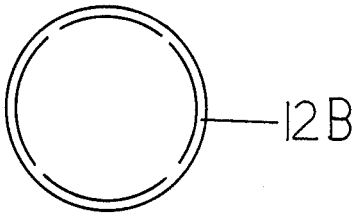
FIG. 16
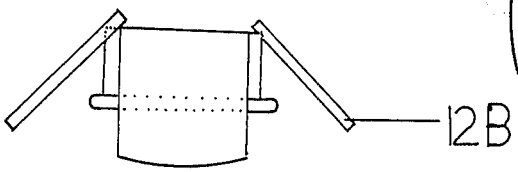
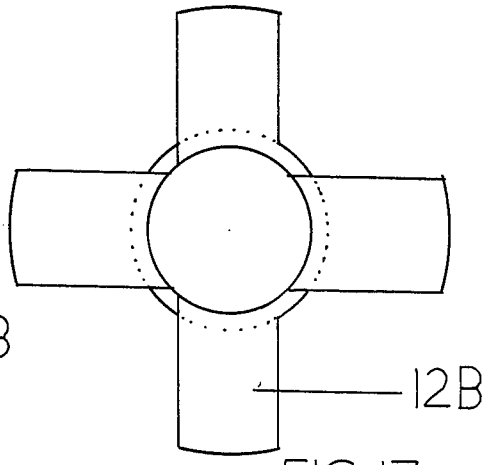
FIG. 17

ARROWHEAD WITH REFILLABLE CARTRIDGES FOR HIGH IMPACT ARROWS

BACKGROUND OF THE INVENTION

Field of the Invention

ARCHERY

In the arrowhead industry, game arrowheads consist of three general groups; broadhead, point, and blunt. My invention will be described in connection with such arrowheads. It is to be understood, however, that my invention is applicable to various types of arrows for high pound rated bows. In designing arrowheads, the main objective is to produce a device that does two things; dislocate matter, and cut to promote bleeding of the game as fast and as effectively as possible.

The broadhead, a stationary type of arrowhead, has a pointed head with either two, three, or four blades and is currently the most common type used to hunt game. There have been many reported cases of the arrows traveling completely through the game, and many wounded animals are not found because the low degree of trauma effected by the low drag of the conventional broadheads often does not cause rapid enough bleeding; therefore, due to delayed trauma, the game may run a great distance before going down, making retrieval difficult and sometimes unsuccessful. Let it be known and clear that circumstance may also be a determining factor, since arrow penetration of vital areas of the game is more likely to result in a quick kill then penetration of the same arrow into a less vulnerable part of the animal. Even so, the numerous cases of animals running hundreds of yards, sometimes miles after being shot in a vital area, often with the arrow passing completely through is indicative of a need for an arrowhead designed to limit game loss.

SUMMARY OF THE INVENTION

It is the object of my invention to provide a high shock device which unlike the stationary type of arrowhead, is designed to deform and expand upon impact, spreading splines in an outward fashion, thus creating greater tissue displacement and thus greater trauma effect after penetration. This design is an improvement over conventional broadheads because the shock upon impact is intense, and the nature of the action promotes bleeding. In the preferred form of my invention, the parts consist of the soft staged tip, retainer band, tri-cut casing, coupler sleeve, and blunt head. The arrowhead is made of two general parts, the head and the cartridge. The cartridge is the casing, tip, and retainer band. The head is the blunt and the coupler sleeve. After impact and recovery, the hunter pulls of the spent cartridge and inserts the new cartridge by pressing it into the coupler sleeve with the fingers. This device is designed for both big game and small game.

BRIEF DESCRIPTION OF THE DRAWING

Referrng to the drawings in which I have for illustrative purposes shown my invention in connection with a blunt arrowhead;

FIG. 13 is the complete arrow.

FIG. 14 is an enlarged and detailed side view of the quad-cut casing.

FIG. 15 is an enlarged and detailed top view of the quad-cut casing.

FIG. 16 is an enlarged and detailed side view of the quad-cut casing after impact.

FIG. 17 is an enlarged and detailed top view of the quad-cut casing after impact.

DESCRIPTION OF THE PREFERRED EMBODIMENTS

Figure 1:
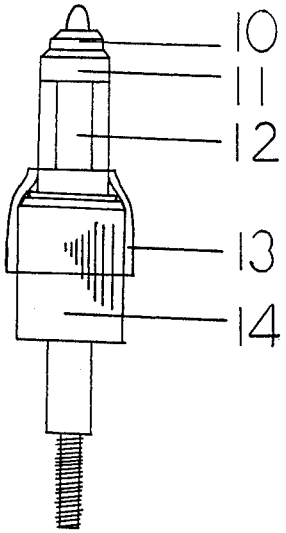
FIG. 1 is a side view of the arrowhead.
Figure 2:
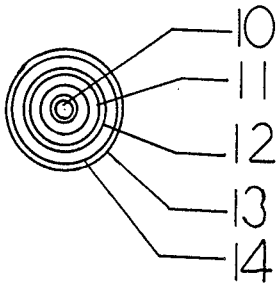
FIG. 2 is a top view of the arrowhead.
Figure 3:
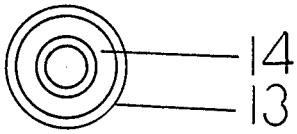
FIG. 3 is a bottom view of the arrowhead.
Figure 4:
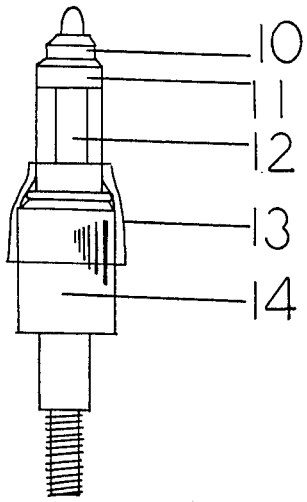
FIG. 4 is a side view of the arrowhead before impact.
Figure 5:
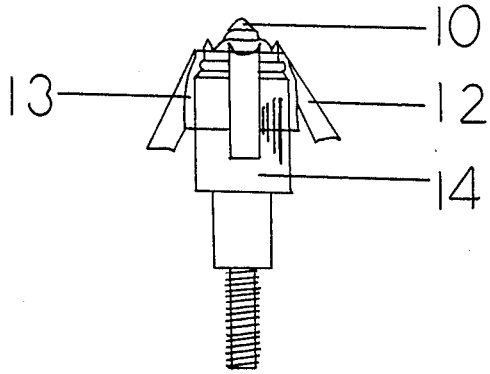
FIG. 5 is a side view of the arrowhead after impact.
Figure 6:
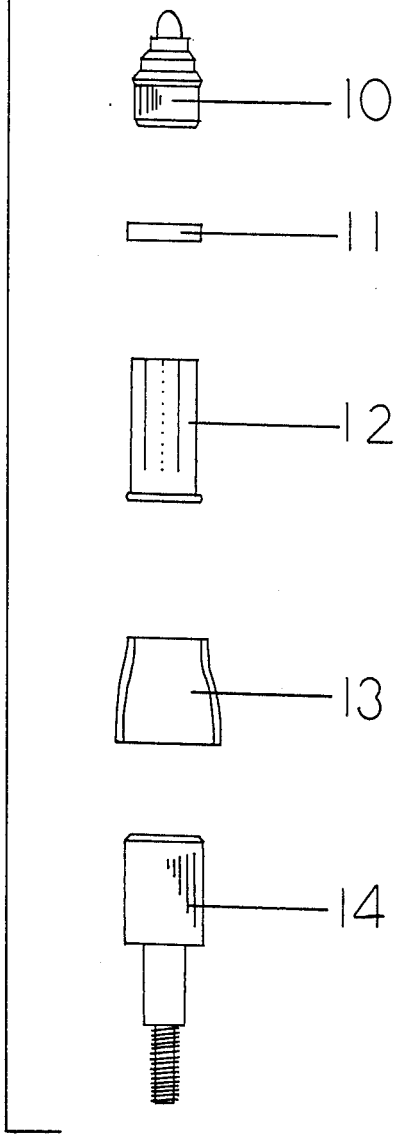
FIG. 6 is an exploded view of the arrowhead.
Figure 7:
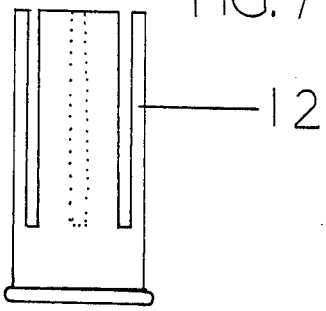
FIG. 7 is an enlarged and detailed side view of the tri-cut casing.
Figure 8:
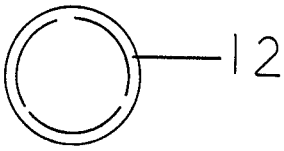
FIG. 8 is an enlarged and detailed top view of the tri-cut casing.
Figure 9:
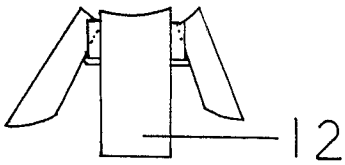
FIG. 9 is an enlarged and detailed side view of the tri-cut casing after impact.
Figure 10:
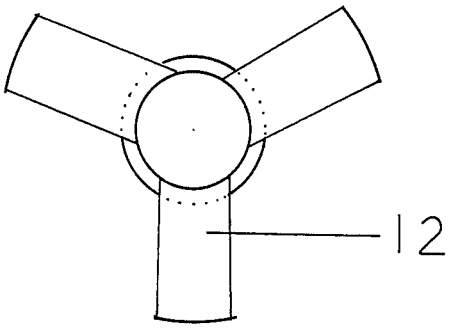
FIG. 10 is an enlarged and detailed top view of the tri-cut casing after impact.
Figure 11:
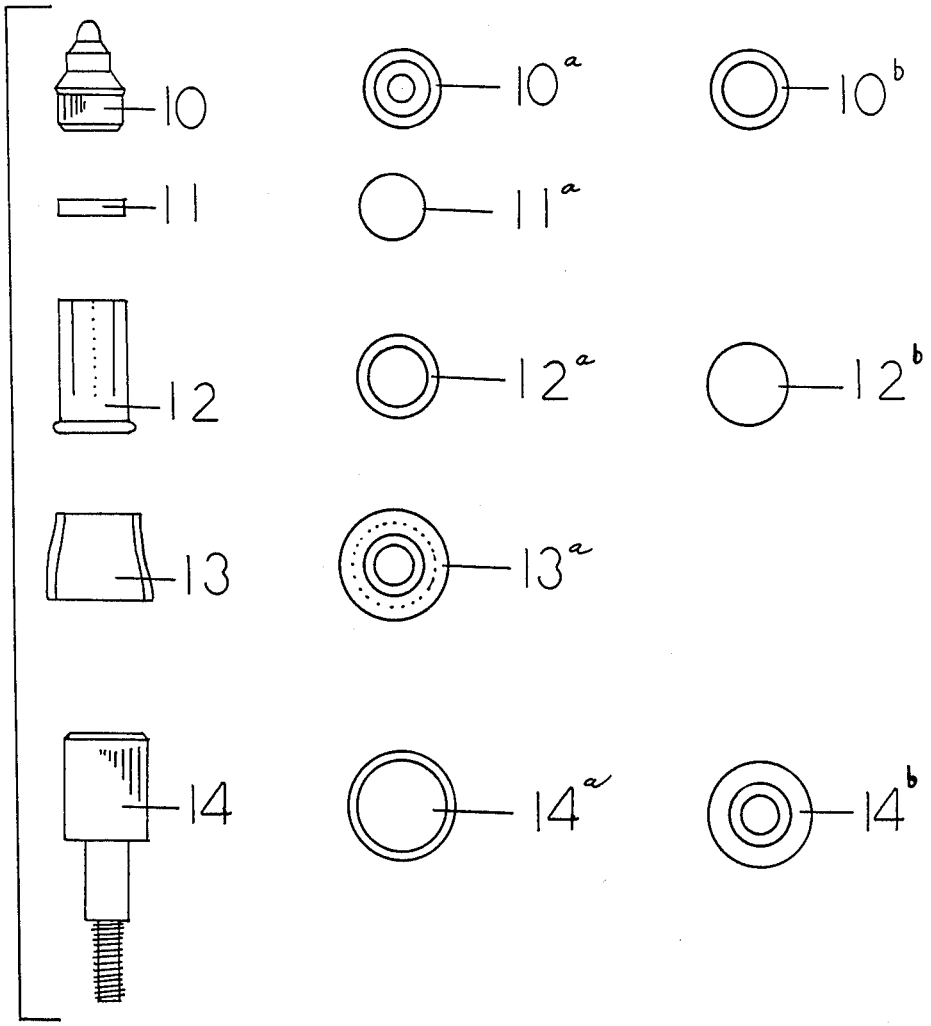
FIG. 11 is an exploded view of the arrowhead with individual top and bottom views of each component.
Figure 12:
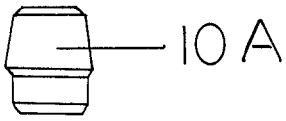
FIG. 12 is the blunted tip of the arrowhead point.

The arrowhead shown in the drawings incorporates the soft staged tip (10), which is pressed into the tri-cut casing (12), with the retainer band (11) holding tension. This part of the device is the refill cartridge. The tri-cut casing (12) sits directly on the blunt (14), coupled securely by the coupler sleeve (13). The device is used by inserting the cartridge (12), into the coupler sleeve (13) as shown in FIG. 4. On impact, the soft tip (10) expands the puncture area, releasing a large amount of energy. On penetration, the tri-cut casing (12) slides over the soft tip (10) three-quarters ($\frac{3}{4}$) of an inch, spreading the three walls (splines) of the casing outward, then immediately back, as shown in FIG. 5. Blunted tip (10-A) type is shown in FIG. 12. The surface area of displacement created by the expanded tri-cut casing (12) increases and decreases by a three to one ratio as shown in FIGS. 9 and 10. The walls of the tri-cut casing then fold back to create a splined mushroom effect, releasing a powerful shock wave as it travels through the medium, as shown in FIG. 5. Upon recovery of the arrow, the spent tri-cut casing (12) is removed and a new tri-cut casing (12) is inserted, as shown in FIG. 1. For small game, the quad-cut casing (12B) as shown in FIG. 14 may be used.

As thus explained, this device is made up of two separate parts, the cartridge and the head, each of independent form; the design of each allowing fast and easy insertion of removal of the cartridge. It is unlikely that the cartridge would not center properly on the blunt, as the type of material used to make the coupler sleeve will be of the proper quality to promote selfcentering of the cartridge.

Various modifications of the herein structure may be made without departing from the scope and spirit of my invention, such, for example, as may be necessary in order to adapt my invention to fit arrows of different sizes; allowing for peel-back of the splines under various densities; modification of the tip (10A), (blunted, as in FIG. 12, for hunting small game, and pointed for hunting big game); change in the length of the casing (12); change in the size of the angle of the splines to 7° for spinner arrows.

There are no moving parts in or on this device in its original form. It is an arrowhead with independent rigid and stationary parts that change form during and after impact. The arrowhead screws into the insert (15) which is glued into the arrowshaft (16), with fletching (17) to stabilize, and the nock (18) to launch.

I claim:

1. An arrowhead for big and small game hunting comprising;

(1) a blunt base element having means for attaching the base element to an arrow shaft, and a surface opposite from said means for attaching for mounting a casing, (2) an elongate hollow casing, comprising a tube of flexible material having a base at one end for mounting on said surface and a plurality of slits in the tube extending rearwardly from the front edge thereof towards the base defining a plurality of splines therebetween, (3) means for removably securing said casing to said base, (4) a tip comprising a rear portion for fitting in the forward end of said casing, an intermediate portion of larger transverse cross-sectional size than said rear portion of said tip and larger than the interior transverse cross-sectional size of said tube, and a game impacting forward portion, and (5) a retainer band surrounding the forward end of said tube for holding said splines against said tip rear portion for retaining the tip on the tube, whereby upon impact with game said tip slides rearwardly into said tube casing said intermediate portion thereof to spread said splines outwardly increasing the area of tissue displacement and trauma effect in the game.

* * * * *